US009062518B2

(12) United States Patent
Patel et al.

(10) Patent No.: US 9,062,518 B2
(45) Date of Patent: Jun. 23, 2015

(54) CHEMICAL INJECTION SYSTEM

(75) Inventors: Dinesh Patel, Sugar Land, TX (US); Ives D. Loretz, Houston, TX (US); Jerome Prost, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 447 days.

(21) Appl. No.: 13/481,424

(22) Filed: May 25, 2012

(65) Prior Publication Data

US 2013/0048303 A1 Feb. 28, 2013

Related U.S. Application Data

(60) Provisional application No. 61/526,531, filed on Aug. 23, 2011.

(51) Int. Cl.

| | |
|---|---|
| ***E21B 34/00*** | (2006.01) |
| ***E21B 34/06*** | (2006.01) |
| ***E21B 34/10*** | (2006.01) |

(52) U.S. Cl.

CPC ..... *E21B 34/10* (2013.01); *E21B 2034/007* (2013.01)

(58) Field of Classification Search

CPC .... E21B 34/06; E21B 34/10; E21B 2034/007
USPC ..... 166/373, 319, 320, 306, 310, 316, 375, 166/53, 374; 251/28, 14, 58
See application file for complete search history.

(56) References Cited

U.S. PATENT DOCUMENTS

| | | | | |
|---|---|---|---|---|
| 4,399,871 | A | 8/1983 | Adkins | |
| 6,491,102 | B2 * | 12/2002 | Leismer et al. | 166/316 |
| 6,668,936 | B2 * | 12/2003 | Williamson et al. | 166/375 |
| 8,408,314 | B2 * | 4/2013 | Patel et al. | 166/373 |
| 2003/0056955 | A1 | 3/2003 | Watson | |
| 2006/0043683 | A1 * | 3/2006 | Ocalan | 277/636 |
| 2006/0231256 | A1 | 10/2006 | Rivas et al. | |
| 2006/0278399 | A1 * | 12/2006 | Dwivedi et al. | 166/375 |
| 2009/0294123 | A1 | 12/2009 | Mescall et al. | |
| 2010/0101788 | A1 | 4/2010 | Mennem | |
| 2010/0300684 | A1 | 12/2010 | Kotsonis et al. | |
| 2011/0067876 | A1 | 3/2011 | Turner | |
| 2011/0079382 | A1 | 4/2011 | Patel | |
| 2011/0079398 | A1 | 4/2011 | Patel et al. | |
| 2013/0048303 | A1 * | 2/2013 | Patel et al. | 166/373 |

* cited by examiner

*Primary Examiner* — Daniel P Stephenson
(74) *Attorney, Agent, or Firm* — David J. Groesbeck; Brandon S. Clark

(57) ABSTRACT

A technique facilitates controlling fluid flows, such as fluid flows in a downhole well zone or zones. A flow control valve is employed to control a fluid flow and is operationally linked with an injection valve. Actuation of the flow control valve is used to automatically actuate the injection valve between corresponding positions allowing or blocking fluid injection. Closing or opening of the flow control valve thus results in a desired corresponding action of the injection valve, such as blocking flow or allowing flow through the injection valve.

18 Claims, 3 Drawing Sheets

CHEMICAL INJECTION SYSTEM

CROSS-REFERENCE TO RELATED APPLICATION

The present document is based on and claims priority to U.S. Provisional Application Ser. No. 61/526,531, filed Aug. 23, 2011, incorporated herein by reference.

BACKGROUND

Chemical injection is used in oilfield applications to mitigate formation of scale, to counteract corrosion, and/or to treat the produced fluids in other ways to alter chemical properties in the downhole environment. In many applications, a single point chemical injection is performed above or below a production packer. The chemical injection is generally continuous and non-selective, i.e. the amount of injected fluid into a specific zone cannot easily be varied over time and in relation to other injection points in the well. Sometimes injected chemicals can build up in an isolated zone and are potentially damaging to the reservoir and associated completion equipment due to the increasing concentration of foreign chemical constituents. Over-injection also represents a potentially wasteful use of costly specialty chemicals or fluids

SUMMARY

In general, the present disclosure provides a system and method for controlling fluid flows, such as fluid flows in a downhole well zone or zones. A flow control valve is employed to control a fluid flow and is operationally linked with an injection valve, e.g. a chemical injection valve. Actuation of the flow control valve is used to automatically actuate the injection valve between corresponding positions allowing or blocking fluid injection to the associated zone.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
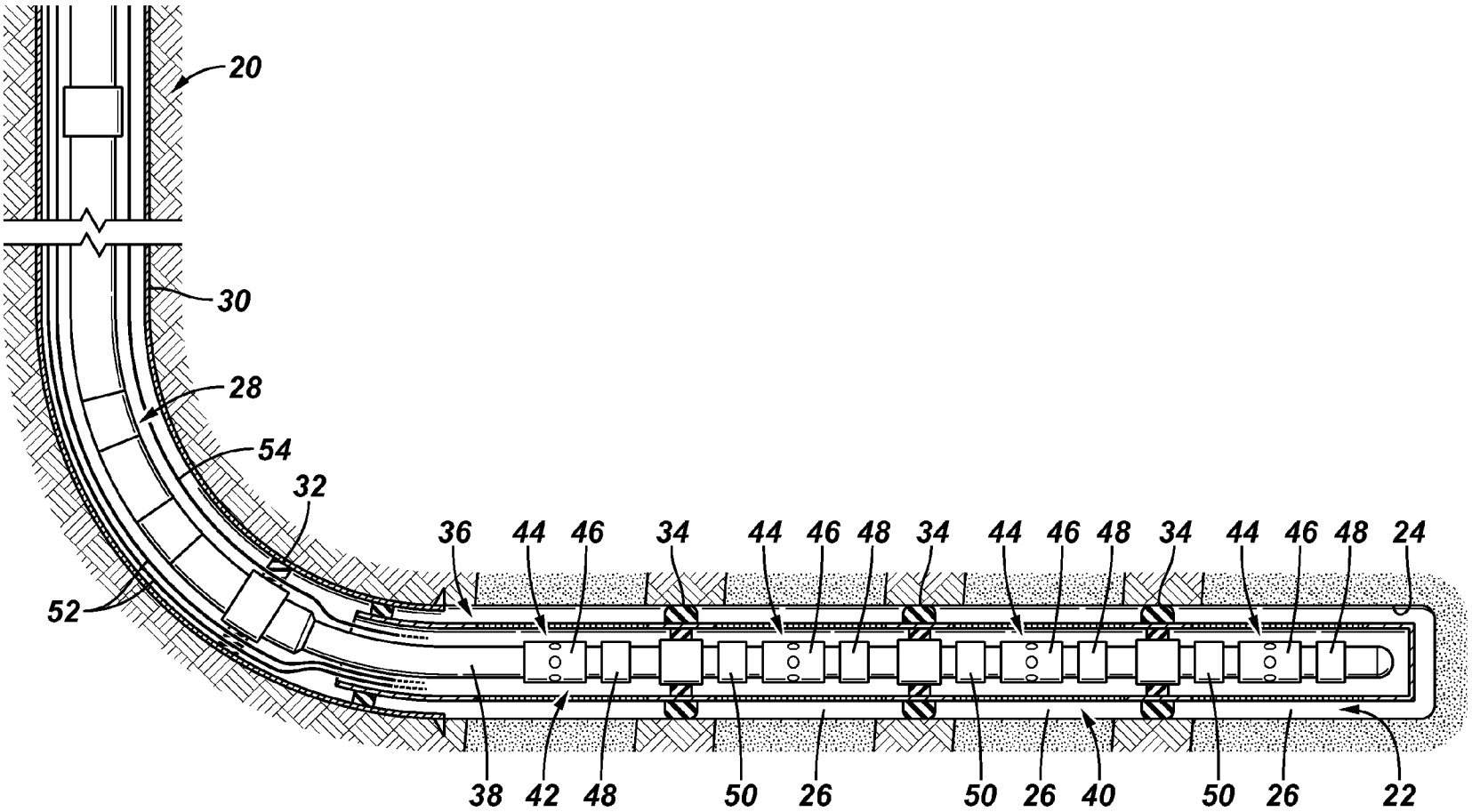
FIG. 1 is an illustration of an example of a well system deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to controlling fluid flows. For example, the system and methodology may be used to control fluid flows in a well application or in another suitable application. A flow control valve is provided to control a flow of fluid, such as a wellbore fluid flow, and an injection valve is coupled with the flow control valve to control injection of secondary injection fluid. In some applications, a mechanical link couples the flow control valve and the injection valve, e.g. chemical injection valve, such that actuation of the flow control valve causes a corresponding actuation of the injection valve. For example, closure of the flow control valve may cause closure (or other desired actuation) of the injection valve. Similarly, opening of the flow control valve may be used to enable opening (or other desired actuation) of the injection valve. In a wellbore embodiment, the flow control valve can be used to shut off further injection of chemicals (or other fluids) via the injection valve when the flow control valve is in its fully closed position. This reduces or eliminates the potential for contaminating an associated reservoir zone with a high concentration of injection fluids.

In some applications, the injection valve may be constructed as an add-on module that may be combined with a downhole flow control valve system to control fluid injection into the same well zone with which the flow control valve is associated. The add-on module may be designed to enable an operational, mechanical coupling with the flow control valve, thus allowing the fluid injection to be controlled via the position or movement of a mechanical member, e.g. mandrel, of the flow control valve. In other applications, the injection valve may be integrated with the flow control valve. For example, the injection valve and the flow control valve may share a common housing which forms part of, for example, a well completion or other type of tubing string.

In wellbore applications, a well system may be designed with a plurality of flow control valves and corresponding injection valves. The well system may be designed for multipoint fluid injection at multiple well zones along a well completion deployed in a wellbore, such as a deviated wellbore. In some applications, the multipoint fluid injection may occur in an annular cavity between an inner tubing string and the inside diameter of a screen base pipe on, for example, an upstream side of each flow control valve. Additionally, such a system allows fluid injection in multiple zones from a single fluid injection line, e.g. chemical injection line, run from the surface. The fluid injection valve may be designed as an on/off valve integrated with an intelligent completion flow control valve.

Referring generally to FIG. 1, an example of a well system is illustrated as comprising a multizone well completion deployed at least in part in a lateral wellbore. The well system can be used in a variety of well applications, including onshore applications and offshore applications. In this example, the completion system is illustrated as deployed in a generally horizontal wellbore of a multi-zone well, however the completion system may be deployed in a variety of wells including various vertical and deviated wells to facilitate production and/or servicing operations.

In the example illustrated in FIG. 1, a well system 20 is deployed in a wellbore 22. The wellbore 22 may comprise a deviated, e.g. horizontal, wellbore section 24 having a plurality of well zones 26. The well system 20 also may comprise a tubing string 28 extending down into the wellbore 22 through, for example, a casing 30. In the embodiment illustrated, well system 20 also has an upper packer 32 and a plurality of zonal isolation packers 34 which form part of a well completion 36 deployed at least in part into the horizontal wellbore section 24. It should be noted, however, that well completion 36 and other components of the overall well system 20 may be deployed in vertical wellbores or other types of wellbores. By way of example, well completion 36 may comprise an inner string 38 and a surrounding filtering system 40, such as a screen, slotted liner, or other suitable filtering system.

Referring again to the example illustrated in FIG. 1, the well system 20 may further comprise a flow control system 42 for controlling fluid flows, e.g. production fluid flows and secondary injection fluid flows, e.g. chemical injection fluid flows. In this example, the flow control system 42 comprises a plurality of flow control assemblies 44, although some applications may utilize a single flow control assembly 44. Each flow control assembly 44 comprises a flow control valve 46 operationally linked with an injection valve 48, e.g. a chemical injection valve. Actuation of individual flow control valves 46 may be used to actuate the injection valve 48 associated with that individual flow control valve 46. As described in greater detail below, the flow control valves 46 may be mechanically or hydraulically linked with corresponding injection valves 48 such that actuation of the flow control valves 46 causes a desired consequent actuation of the injection valves 48. In the example illustrated, the flow control valves 46 and the injection valves 48 are part of well completion 36, and the injection valves 48 may be chemical injection valves 48.

Depending on the type of well application, well completion 36 and overall well system 20 may comprise a variety of other components and systems arranged in several types of configurations. By way of example, the well completion 36 may incorporate a variety of sensors 50, such as pressure/temperature gauges or a variety of other types of sensors. In some applications, the flow control valves 46 and the associated chemical injection valves 48 are employed in an intelligent completion which utilizes data obtained from sensors 50 to control various production and/or service parameters. For example, the well completion 36 may be designed to improve operation of the well by controlling production fluid flows from each of the well zones 26 while also controlling the injection of chemicals into each of the well zones 26. The well system 20 also may comprise a variety of control lines, such as hydraulic control lines 52 for operating flow control valves 46 and at least one chemical injection line 54 to deliver chemical injection fluid to the chemical injection valves 48. In some applications, the linked design of flow control valves 46 and chemical injection valves 48 enables use of a single chemical injection line 54 which supplies chemical injection fluid to multiple injection points.

Figure 2:
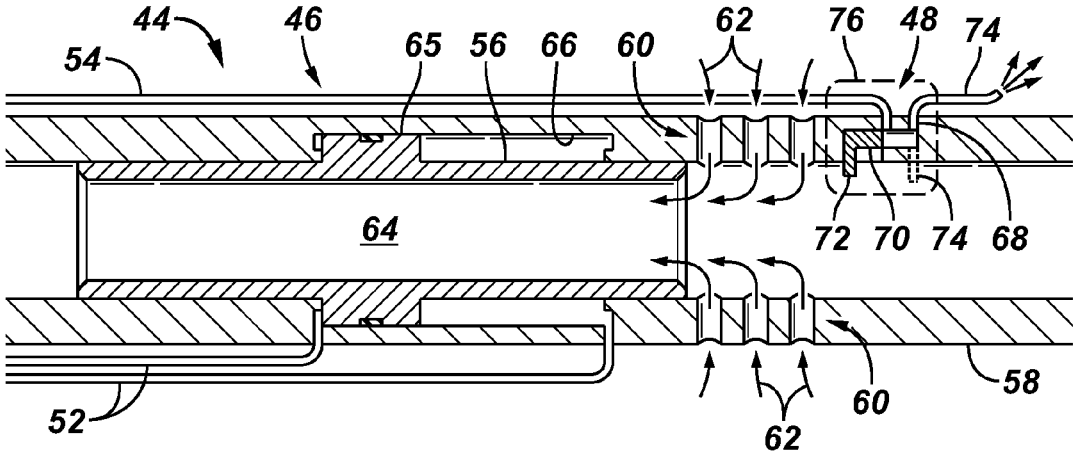
FIG. 2 is an illustration of an example of a valve system having an injection valve operationally linked with a flow control valve, according to an embodiment of the disclosure.
Figure 3:
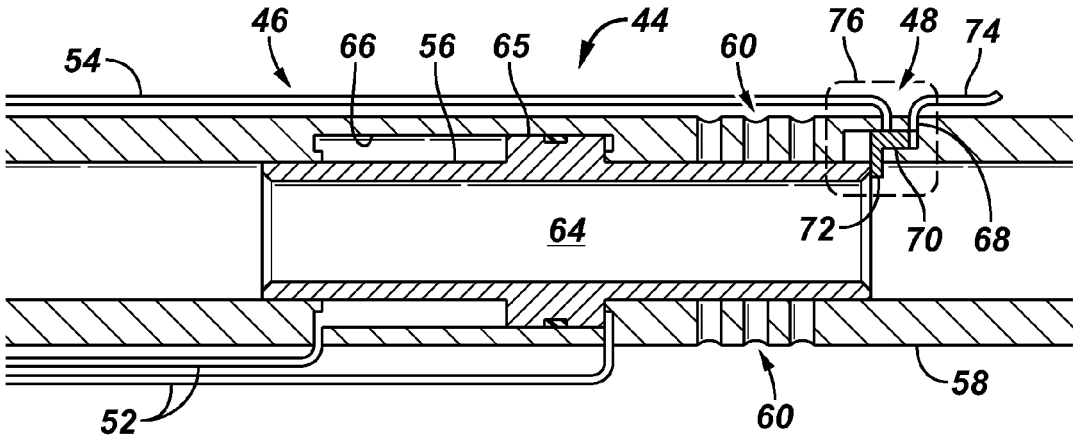
FIG. 3 is an illustration similar to that of FIG. 2 but showing the valve system in a different operational position, according to an embodiment of the disclosure.

An example of flow control assembly 44 is illustrated in FIGS. 2 and 3. In this embodiment, the flow control assembly 44 comprises flow control valve 46 operationally linked with its corresponding chemical injection valve 48. By way of example, the flow control valve 46 comprises a movable member 56, e.g. a mandrel, slidably received in a surrounding housing 58. The housing 58 includes a flow port 60 which may be an individual port or a plurality of ports. The mandrel 56 is slidably mounted for movement between positions allowing flow through flow port 60, as illustrated in FIG. 2, or blocking flow through port 60, as illustrated in FIG. 3. In some applications, flow port 60 may comprise a plurality of sequential ports aligned such that movement of the mandrel 56 over a specific distance can be used to control the amount of flow through port 60. In well applications, the flow control valve 46 and mandrel 56 can be used to control the inflow of a produced well fluid, as indicated by arrows 62. A fluid flowing in through port 60 may be directed through an interior flow passage 64, e.g. a production fluid flow passage, extending through mandrel 56, flow control valve 46, and well completion 36.

Movable member 56 may be in the form of a mandrel or other type of structure designed to interact with the corresponding chemical injection valve 48. In the example illustrated, the movable member 56 is in the form of a mandrel having a piston portion 65 slidably received in a corresponding cylinder 66 of housing 58. Hydraulic fluid may be delivered to cylinder 66 via hydraulic control lines 52 on either side of piston portion 65 to open the flow control valve 46, as illustrated in FIG. 2, or to close the flow control valve 46, as illustrated in FIG. 3.

The chemical injection valve 48 is coupled to chemical injection line 54 and comprises a chemical injection port 68. Flow through the chemical injection port 68 is allowed or blocked by a flow control member 70 which is selectively moved by the movable member/mandrel 56 of flow control valve 46. In the embodiment illustrated, mandrel 56 mechanically engages the flow control member 70 via, for example, an extension 72 which extends down into the path of movement of mandrel 56. In this example, extension 72 serves as a mechanical link between the flow control mandrel 56 and the flow control member 70. Movement of mandrel 56 to a desired actuation position can be used to cause a corresponding movement of the flow control member 70 to a desired actuation position. By way of example, positioning of the mandrel 56 in an open flow position may be designed to leave flow control member 70 in an open flow chemical injection position, as illustrated in FIG. 2. However, movement of mandrel 56 to the closed flow position causes the mandrel 56 to mechanically engage extension 72 and to move the flow control member 70 to a position blocking flow through the chemical injection port 68, as illustrated in FIG. 3. Accordingly, actuation of the flow control valve 46 can be used to automatically actuate the chemical injection valve 48.

The configuration of chemical injection valve 48 may vary according to a desired injection application. For example, the chemical injection port 68 may be coupled with an injection flow line or flow path 74 oriented to inject a chemical in a region external of the housing 58, e.g. into a region between inner tubing string 38 and the surrounding annular area. In some applications, however, flow path 74 may be oriented to conduct the chemical to an internal region within the wellbore completion as indicated by the flow line 74 shown in dashed lines in FIG. 2. Depending on the application, the flow control valve 46 and the chemical injection valve 48 may both be mounted in the common housing 58. However, the chemical injection valve 48 also may be designed as a separate module 76 that may be connected to the flow control valve 46 by, for example, threaded engagement or separate fasteners.

Figure 4:
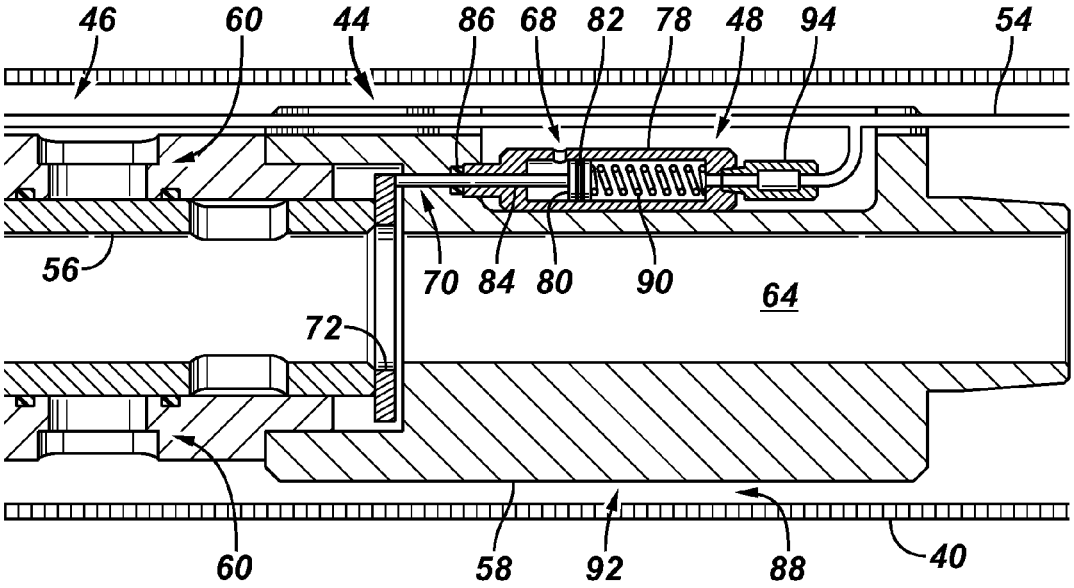
FIG. 4 is an illustration of another example of a valve system having an injection valve operationally linked with a flow control valve, according to an embodiment of the disclosure.
Figure 5:
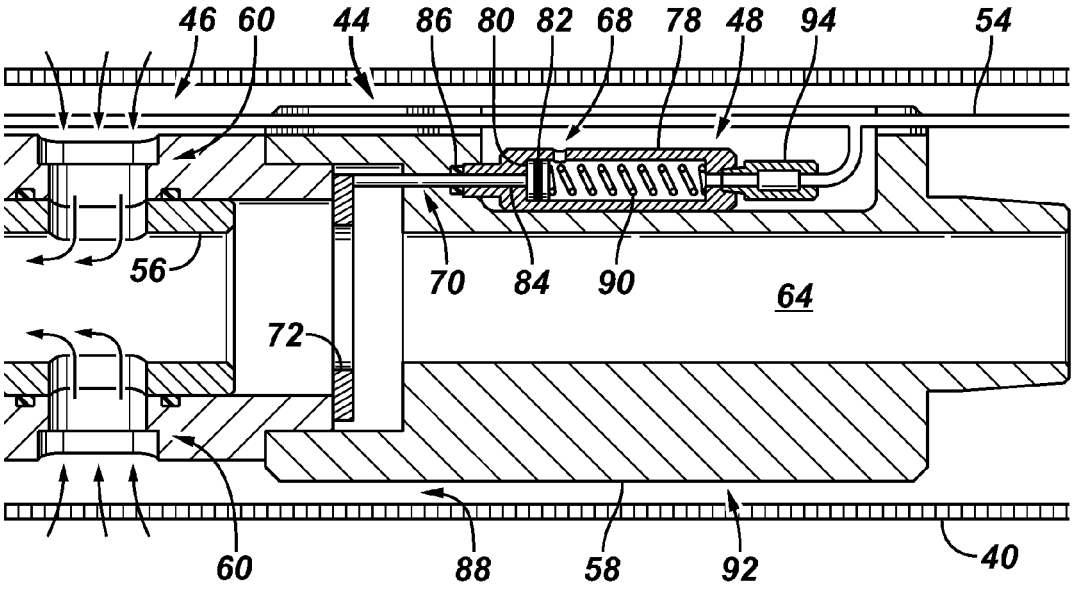
FIG. 5 is an illustration similar to that of FIG. 4 but showing the valve system in a different operational position, according to an embodiment of the disclosure.

Referring generally to FIGS. 4 and 5, another embodiment of the flow control assembly 44 is illustrated. In this embodiment, the chemical injection valve 48 is again coupled with a corresponding flow control valve 46 and positioned in a flow control environment. For example, individual or plural flow control assemblies 44 may be positioned in a well environment, e.g. within filtration system 40. In the example illustrated, the flow control valve 46 and the chemical injection valve 48 may share a common housing 58; or housing 58 may comprise separate components joined together such that actuation of the movable member/mandrel 56 can be used to actuate the chemical injection valve 48.

By way of example, the chemical injection valve 48 comprises flow control member 70 slidably mounted within a chemical injection valve cartridge 78. The flow control member 70 is formed with a piston 80 having a seal 82 which sealingly engages an inner cylindrical surface of the chemical injection valve cartridge 78. The piston 80 is coupled to extension 72 via a shaft 84 which extends through the chemical injection valve cartridge 78 and a surrounding seal 86. The extension 72 of flow control member 70 may be constructed as a ring positioned to abut an end of the mandrel 56.

When mandrel 56 is actuated to block flow through flow ports 60, as illustrated in FIG. 4, the mandrel 56 mechanically engages extension 72 and moves piston 80 to a closed position preventing injection of chemicals through chemical injection port 68. However, as mandrel 56 is shifted back to an open flow position, as illustrated in FIG. 5, the piston 80 moves to allow flow of chemical injection fluid through chemical injection port 68. By way of example, the chemical injection fluid may be injected into an annular space 88 external of housing 58 or it may be injected internally into fluid flow along flow path 64.

In some applications, the flow control member 70, e.g. piston 80, may be spring biased in a desired direction by a spring 90. For example, the flow control member 70 may be biased to an open position allowing the chemical injection fluid to be injected. As illustrated in FIG. 5, actuation of mandrel 56 to allow flow through flow ports 60 moves the end of the mandrel 56 away from extension 72 and allows spring 90 to shift piston 80 and flow control member 70 to the open flow position. In the specific example illustrated, the chemical injection valve 48 is disposed within a chemical injection sub 92 and also comprises a fluid metering device 94 located in the chemical injection sub 92. The fluid metering device 94 meters fluid supplied by chemical injection line 54 and directs the chemical injection fluid into the interior of chemical injection valve cartridge 78. As piston 80 is shifted to the open flow position (see FIG. 5), chemical injection fluid flows through fluid metering device 94, through the interior of chemical injection valve cartridge 78, and out through chemical injection port 68.

As described herein, the actuation of the chemical injection valve 48 and the flow control valve 46 are integrated, however the flow control valve 46 can be used to actuate the chemical injection valve 48 in a variety of ways. For example, shifting the flow control valve 46 to an open flow configuration can be used to either allow or block flow of injection fluid through the chemical injection valve 48. In certain well related applications, the chemical injection valve 48 closes and chemical injection is stopped when the flow control valve 46 is closed. For example, downward motion of the flow control valve mandrel 56 can be used to close the chemical injection valve 48. The chemical injection valve 48 then opens when the flow control valve is shifted to an open or choked flow position. However, the flow control valve 46 and the chemical injection valve 48 can be arranged so that closure of the flow control valve 46 causes the chemical injection valve 48 to shift to an open position.

The injection rate in each well zone 26 may be controlled by the fluid metering device 94 in the associated chemical injection valve 48. Depending on the application, the fluid metering device 94 may be a fixed choke device, a constant flow rate device, or another suitable type of device. The overall design, when used in a wellbore, enables chemical injection at multiple points (zones) in a producing formation from a single control line 54 run from the surface.

In wellbore applications, the well system 20 may be constructed in a variety of configurations. For example, the chemical injection point may be shifted to various locations to facilitate a chemical injection procedure, e.g. the chemical injection point may be moved farther up or down the annulus to help optimize mixing before production fluid enters the corresponding flow control valve 46. The injection of chemicals may be external or internal with respect to the chemical injection valve 48 depending on the application. Also, the injection may be designed to occur while the flow control valve is in an open flow position or a closed flow position depending on the parameters of a given application. For example, some chemical injection applications may be designed to treat a non-producing zone with chemicals or to allow for certain fluid sampling capabilities with respect to isolated well zones.

Most of the example applications described herein have elaborated on the general application of chemical injection treatments for one or multiple points in a well. However, it should be noted that the sample embodiments also may be useful to selectively deliver other types of fluids or mixtures to target zones. In other words, the injected fluids may not be chemically reactive relative to the produced fluids, but they may instead be selected to aid the reservoir or production management in other ways, e.g. gas lift assistance, providing thinning or thickening agents, and/or heating or cooling. In various applications, the embodiments disclosed allow for the selective delivery of pumpable agents to various zones by leveraging existing control infrastructure that may already be part of installed flow control valves in each zone.

The various embodiments described herein enable control over the chemical injection valves 48 without requiring any additional control lines or power sources. However, some applications may utilize additional control lines and/or power sources to facilitate various servicing and/or production applications. The control mechanism of each chemical injection valve 48 is independent of the hydraulic control chamber of the corresponding flow control valve 46. In at least some applications, coupling between the flow control valve and the corresponding chemical injection valve is by a simple, mechanical mechanism which minimizes the potential for failure propagation from one system to the other. Consequently, individual or multiple flow control assemblies 44 may be used in a variety of environments and in a variety of well and non-well related applications.

Depending on the downhole application, the well completion configuration, and the desired function of the overall well system, various embodiments described herein may be used to facilitate a variety of production and/or servicing operations. Accordingly, the overall well system may comprise many types of components and arrangements of components. Additionally, the flow control valves and chemical injection valves described herein may be used with a variety of devices and systems, including a variety of subs, sensors, valves, gauges, injection assemblies, and other components designed to facilitate a given production or servicing operation. The specific components and arrangements of components used for single zone or multiple zone systems may be constructed in various designs and configurations depending on the parameters of a specific application.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for controlling flow, comprising:

a flow control valve having a housing with a flow port, the flow control valve further comprising a mandrel slidably mounted in the housing for movement between positions blocking flow and allowing flow through the flow port; and an injection valve coupled to an injection line, the injection valve having an injection port and a flow control member movable between positions blocking flow and allowing flow through the injection port, the injection valve being positioned in cooperation with the flow control valve such that movement of the mandrel to a given position automatically actuates the injection valve by mechanically moving the flow control member.

2. The system as recited in claim 1, wherein movement of the mandrel to close the flow port causes the flow control member to move to a position closing the injection port.

3. The system as recited in claim 1, wherein the injection valve is a chemical injection valve mounted at least partially in the housing of the flow control valve.

4. The system as recited in claim 1, wherein the flow control valve and the injection valve are positioned in a wellbore completion.

5. The system as recited in claim 4, wherein the injection port is coupled with a flow path oriented to conduct a chemical to a region external of the injection valve.

6. The system as recited in claim 4, wherein the injection port is coupled with a flow path oriented to conduct a chemical to an internal region within the wellbore completion.

7. The system as recited in claim 1, wherein the flow control member is spring biased to a position allowing flow through the injection port.

8. A system for controlling fluid flows, comprising:

a well system deployed in a wellbore, the well system comprising:

a plurality of packers isolating a plurality of well zones;

a plurality of flow control devices positioned to control flow of fluid between the plurality of well zones and an interior of the well system; and a plurality of chemical injection valves, each chemical injection valve being linked with a corresponding flow control valve of the plurality of flow control valves so as to be actuated automatically upon actuation of the corresponding flow control valve, wherein each chemical injection valve comprises a flow control member which is mechanically moved by a mandrel of its corresponding flow control valve.

9. The system as recited in claim 8, wherein each chemical injection valve and its corresponding flow control valve is positioned along the well system to control production fluid flow and chemical injection with respect to a specific well zone of the plurality of well zones.

10. The system as recited in claim 8, wherein selective movement of the mandrel blocks or allows flow through a flow port of the flow control valve.

11. The system as recited in claim 10, wherein movement of the mandrel to close the flow port causes the flow control member to move and block flow through a chemical injection port of the chemical injection valve.

12. The system as recited in claim 8, wherein the well system further comprises a common chemical injection line for supplying an injection chemical to the plurality of chemical injection valves.

13. The system as recited in claim 8, wherein the flow control member of each chemical injection valve is spring biased in a direction opposing movement of the mandrel.

14. A method for controlling fluid flow, comprising:

positioning a flow control valve in a wellbore to control fluid flow between an exterior and an interior of a well system;

operationally linking an injection valve with the flow control valve; and actuating the injection valve by shifting a mechanical member of the flow control valve, wherein operationally linking comprises providing a mechanical link between a flow control mandrel of the flow control valve and a flow control member of the injection valve.

15. The method as recited in claim 14, wherein positioning comprises positioning a plurality of the flow control valves and a plurality of the injection valves along a well completion such that each injection valve is actuated by a corresponding flow control valve of the plurality of flow control valves.

16. The method as recited in claim 14, wherein actuating comprises shifting the flow control mandrel to block flow through a flow port and thus mechanically moving the flow control member via the flow control mandrel to block flow through a chemical injection port.

17. The method as recited in claim 16, wherein actuating comprises shifting the flow control mandrel to allow flow through the flow port and thus releasing the flow control member to allow flow through the chemical injection port.

18. The method as recited in claim 14, further comprising mounting the flow control valve and the injection valve in a common housing.

* * * * *